US006578775B2

(12) United States Patent
Hokao

(10) Patent No.: US 6,578,775 B2
(45) Date of Patent: Jun. 17, 2003

(54) FUEL INJECTOR

(75) Inventor: Takayuki Hokao, Anjo (JP)

(73) Assignee: Denso Corporation, Aichi-Pref. (JP)

( * ) Notice: Subject to any disclaimer, the term of this patent is extended or adjusted under 35 U.S.C. 154(b) by 0 days.

(21) Appl. No.: 10/109,851

(22) Filed: Apr. 1, 2002

(65) Prior Publication Data

US 2002/0139872 A1 Oct. 3, 2002

(30) Foreign Application Priority Data

Mar. 30, 2001 (JP) ..... 2001-100309

(51) Int. Cl.[7] ..... B05B 1/24

(52) U.S. Cl. ..... 239/135; 239/128; 239/130; 239/132; 239/133; 239/585.1; 239/585.2; 239/585.5

(58) Field of Search ..... 239/128, 130, 239/132, 133, 135, 585.1, 585.2, 585.3, 585.4, 585.5, 583, 584

(56) References Cited

U.S. PATENT DOCUMENTS 5,758,826 A * 6/1998 Nines ..... 239/585.1
5,915,626 A 6/1999 Awarzamani et al.
6,109,543 A * 8/2000 Bright et al. ..... 239/135
6,422,481 B2 * 7/2002 Ren et al. ..... 239/135

FOREIGN PATENT DOCUMENTS

JP 54-112917 9/1979

* cited by examiner

*Primary Examiner*—Robin O. Evans
(74) *Attorney, Agent, or Firm*—Nixon & Vanderhye PC

(57) ABSTRACT

In a fuel injector, a valve member in a hollow cylindrical shape having a bottom is enclosed and supported in a magnetic cylinder defining a fuel passage to reciprocate in an axial direction. At least two of the ceramic heaters having an arc shape in cross section are arranged on the outer periphery of the magnetic cylinder in a circumferential direction to be a cylindrical shape. The ceramic heaters are pressed toward the outer periphery of the magnetic cylinder by a heater holder with a small resiliency. The ceramic heaters are tightly fitted on the outer peripheral surface of the magnetic cylinder without being damaged. Therefore, heat of the ceramic heaters is conducted to the magnetic cylinder and fuel in the magnetic cylinder is effectively heated.

19 Claims, 6 Drawing Sheets

FUEL INJECTOR

CROSS REFERENCE TO RELATED APPLICATION

This application is based on Japanese Patent Application No. 2001-100309 filed on Mar. 30, 2001, the disclosure of which is incorporated herein by reference.

FIELD OF THE INVENTION

The present invention relates to a fuel injector of an internal combustion engine.

BACKGROUND OF THE INVENTION

It is recognized that heating of fuel during cold engine starting will reduce harmful components in exhaust gas. In a fuel injector, a heating element is generally provided radially outside of a vale body to heat fuel in the valve body and atomize it during cold starting. As the heating element, a ceramic heater is widely used. In a fuel injector 100 shown in FIG. 8, for example, a valve member 101 opening/closing a valve seat orifice has a cylindrical shape having a bottom. A valve body 103 encloses the valve member 101 and supports it to reciprocate. A ceramic heater 102 in the cylindrical shape is provided on the outer periphery of the valve body 103.

SUMMARY OF THE INVENTION

It is an object to provide a fuel injector in which fuel is effectively heated and atomized.

It is another object to provide a fuel injector in which a ceramic heater is mounted without being damaged.

It is a further object to provide a fuel injector in which a ceramic heater is tightly fitted to improve heat conductivity.

It is a still further object to provide a fuel injector in which fuel is effectively heated irrespective of variation in the size of a ceramic heater.

According to one aspect of the present invention, a plurality of ceramic heaters is provided on the outer periphery surface of a valve body. Each of the plurality of ceramic heaters has an arc shape in cross section and arranged in a circumferential direction to surround the outer periphery of he valve body. According to this, the plurality of ceramic heaters is mounted without being damaged and tightly fitted on the outer peripheral surface of the valve body. Ther fore, heat from the plurality of ceramic heaters is effectively conducted to the valve body. As a result, fuel in the valve body is effectively heated.

According to another aspect of the present invention, a heating element is press fitted in a holder and the holder is press-fitted to a valve body. The valve body defines a fuel passage therein and a valve member is supported in the valve body to reciprocate in an axial direction. Accordingly, it is not necessary to press-fit the ceramic heater on the valve body. Since the holder contacts both of the heating element and the valve body, heat from the heating element is not only directly conducted to the valve body but also conducted to the valve body through the holder. Therefore, the fuel is effectively heated.

BRIEF DESCRIPTION OF THE DRAWINGS

Other objects, features and advantages of the present invention will become more apparent from the following detailed description made with reference to the accompanying drawings, in which.

DETAILED DESCRIPTION OF THE PREFERRED EMBODIMENTS

First Embodiment

Figure 1:
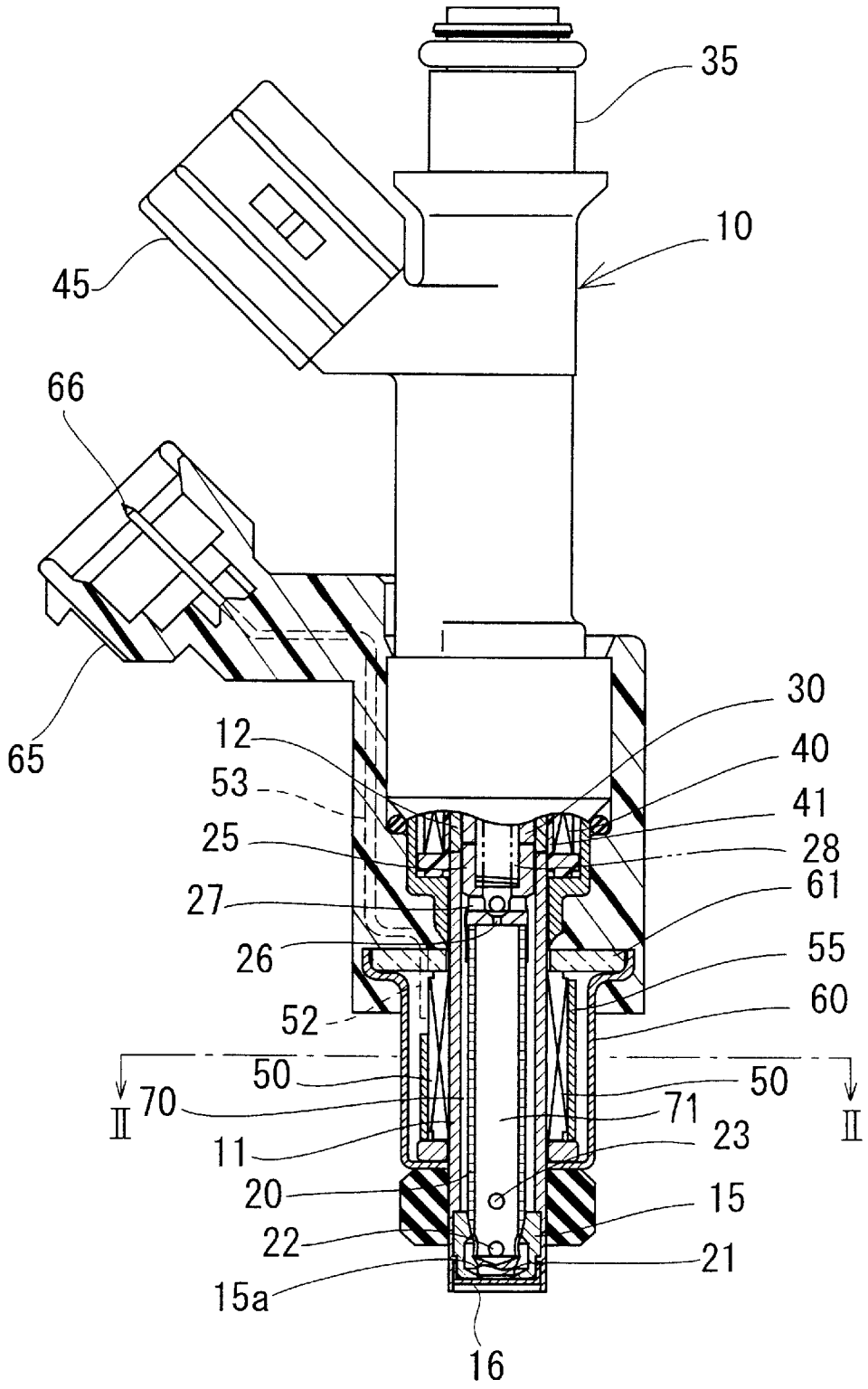
FIG. 1 is a side view of a fuel injector, partly in cross-section, according to the first embodiment of the present invention.

In a fuel injector 10 shown in FIG. 1, a valve body includes a magnetic cylinder 11 and a valve seat body 15. The magnetic cylinder 11 encloses and supports a valve member 20 to reciprocate therein in an axial direction. A fuel passage 70 is defined between the inner peripheral surface of the magnetic cylinder 11 and the outer peripheral surface of the valve member 20. The valve seat body 15 and a cup-shaped orifice plate 16 are provided inside of the magnetic cylinder 11 at a fuel injection side (bottom side in FIG. 1). A non-magnetic cylinder 12 is provided at an upstream fuel side of the magnetic cylinder 11 to separate the magnetic cylinder 11 from a fixed core 30.

The valve member 20 has a hollow cylindrical-shape having a bottom and defines a fuel passage 71 therein. The bottom of the valve member 20 provides a contact portion 21 that can be seated on a valve seat 15*a* of the valve seat body 15. The orifice plate 16 is press-fitted to the valve seat body 15 and fixed to the outer wall of the valve seat body 15 by laser welding. A plurality of orifices is formed in a middle portion of the orifice plate 16.

When the contact portion 21 is seated on the valve seat 15*a*, fuel injection from the orifices is stopped. When the contact portion 21 is lifted from the valve seat 15*a*, fuel is injected from the orifices. A fuel injection side end of the valve member 20 is supported at the valve seat body 15 to be reciprocally slidable in the valve seat body 15. The other side end of the valve member 20 which is on a non-fuel injection side, is welded to a movable core 25. A plurality of communicating holes 22 and 23 are formed on the valve member 20 at the fuel side to communicate an inside and an outside of the valve member 20. The communication holes 22 and 23 are spaced from each other in the axial direction. The communication holes 22 and 23 are located at a downstream fuel side of ceramic heaters 50. The communication holes 22 are located at the downstream fuel side of a sliding area of the valve seat body 15. The communication holes 23 are located at the upstream fuel side of the sliding area of the valve seat body 15.

A throttle pipe 26 is provided at the fuel injection side of the movable core 25. A plurality of communicating holes 27 are provided at the upstream fuel side of the throttle pipe 26. A fuel flowing area in the throttle pipe 26 is smaller than a 20 fuel flowing area in the communication holes 27. Therefore, fuel drawn from a fuel inlet 35 mainly flows into the fuel passage 70 through the communication holes 27.

The fixed core 30 is opposite to the movable core 25 in the axial direction. A spring 28 biases the movable core 25 and the valve member 20 toward the valve seat 15*a*. A spool 41 is located radially outside of the magnetic cylinder 11 and the non-magnetic cylinder 12. A coil 40 is wound around the spool 41. The coil 40 and the spool 41 are covered with a resin molded connector 45. The coil 40 is electrically connected to a terminal inside of the connector 45.

Figure 2:
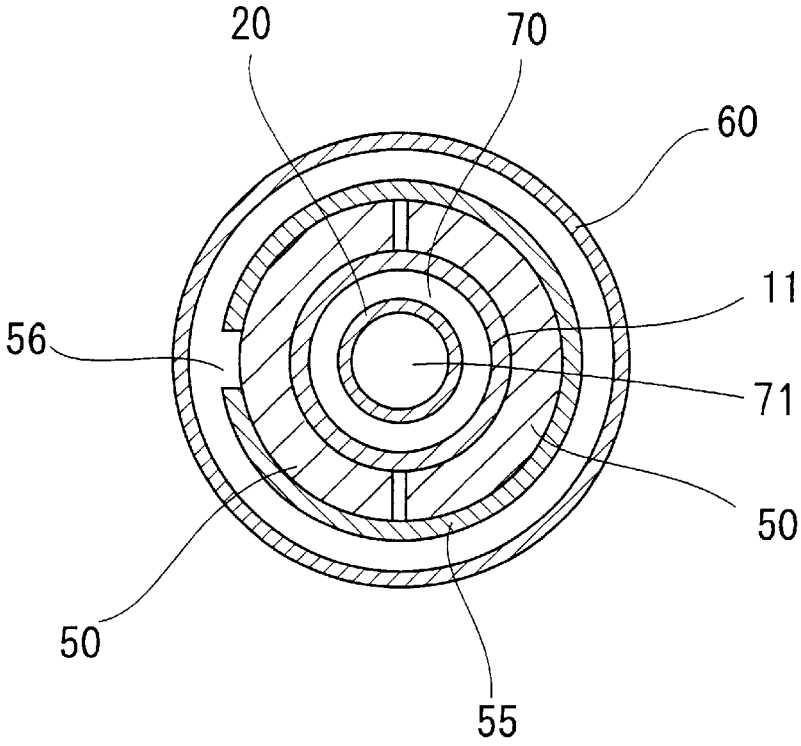
FIG. 2 is a cross-sectional view of the fuel injector taken along line II—II in FIG. 1.

The ceramic heaters 50 as a heating element are made of a heat resistor sintered by ceramics. PTC (positive temperature coefficient) heater is included in the ceramic heater 50. At least two ceramic heaters 50 having an arc shape in cross section are arranged on the outer periphery of the magnetic cylinder 11 in a circumferential direction, as shown in FIG. 2.

Figure 3:
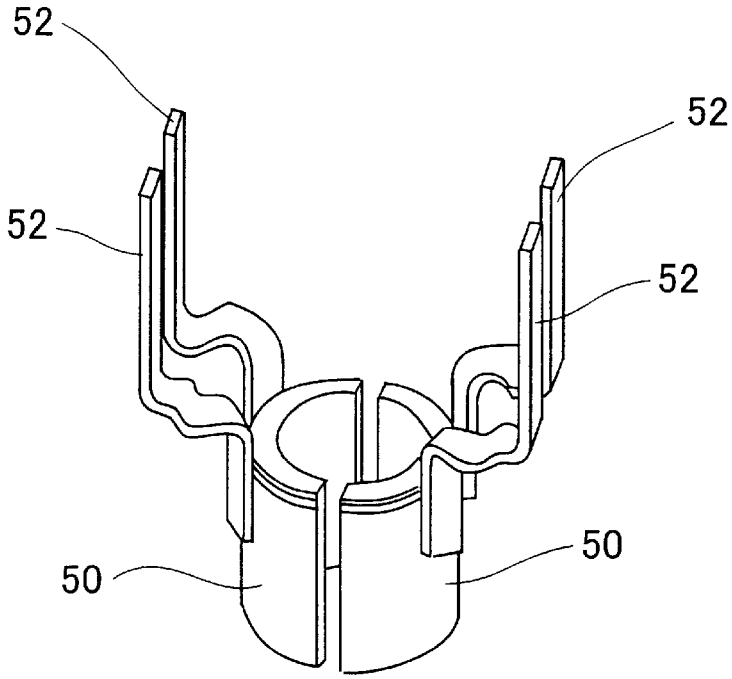
FIG. 3 is a perspective view of a ceramic heater used in the first embodiment.

The ceramic heaters 50 are surrounded with a heater holder 55. The heater holder 55 is made of a material having good thermal conductivity, for example, copper, and brass. The heater holder 55 has a slit 56 extending in the axial direction. The heater holder 55 presses the ceramic heaters 50 to the outer peripheral surface of the magnetic cylinder 11 with a small resiliency. A curvature of the inner peripheral surface of each ceramic heater 50 is substantially the same as that of the outer peripheral surface of the magnetic cylinder 11. Therefore, the inner peripheral surface of the ceramic heater 50 can tightly contact the outer peripheral surface of the magnetic cylinder 11. Copper electrodes 52 are soldered to the ceramic heater 50 with a brazing material and the like, as shown in FIGS. 1 and 3. The electrodes 52 are electrically connected to a terminal 66 embedded in a connector 65 through electric wires 53. The ceramic heaters 50 and the outer periphery of the heater holder 55 are surrounded with a cover 60. A sealing member 61 is made of ceramics. The sealing member 61 closes an axial opening of the cover member 60 to restrict molding resin of the connector 65 from entering the cover member 60.

Fuel drawn from the fuel inlet 35 passes through a fuel pipe defined in the fixed core 30. Then, the fuel flows into the fuel passage 70 through the communicating holes 27. Further, the fuel flows into the fuel passage 71 through the communicating holes 23 and then flows out of the valve member 20 through the communicating holes 22. Then, the fuel sprays out from the orifices of the plate 16 through a space defined between the contact portion 21 and the valve seat 15*a* when the valve member 20 is lifted from the valve seat 15*a*. A part of the fuel does not flow into the fuel passage 70 through the communicating holes 27, but enters the fuel passage 71 through the throttle pipe 26. This fuel then flows out of the valve member 20 through the communicating holes 22 and sprays out from the orifices of the plate 16.

In this injector 10, when an electric power supply to the coil 40 is stopped, the valve member 20 is biased to the downstream fuel side by the spring 28, so that the contact portion 21 of the valve member 20 is seated on the valve seat 15*a*. In this way, the valve seat body 15 is closed and fuel spraying from the orifices of the plate 16 is stopped.

When the electric power is supplied to the coil 40, magnetic flux generated in the coil 40 is guided in a magnetic circuit surrounding the coil 40, so the magnetic attracting force is generated between the fixed core 30 and the movable core 25. The movable core 25 and the valve member 20 are attracted toward the fixed core 30 so that the contact portion 21 is lifted from the valve seat 15*a*. In this way, the fuel is sprayed from the orifices.

Right after an engine starts by turning on an ignition switch, an electric current is supplied to the ceramic heaters 50 for a predetermined time. When the electric current supply is started, the ceramic heaters 50 immediately generate heat. When the electric power is supplied to the coil 40 and the valve member 20 is lifted from the valve seat 15*a* while the electric current is being supplied to the ceramic heaters 50, the fuel flowing in the fuel passage 70 is heated through the magnetic cylinder 11 contacting the ceramic heaters 50. When the heated fuel is sprayed out from the orifices, the fuel is boiled under reduced pressure and atomized. Therefore, it is effective to reduce harmful components in an exhaust gas during the cold starting of the engine.

Figure 4:
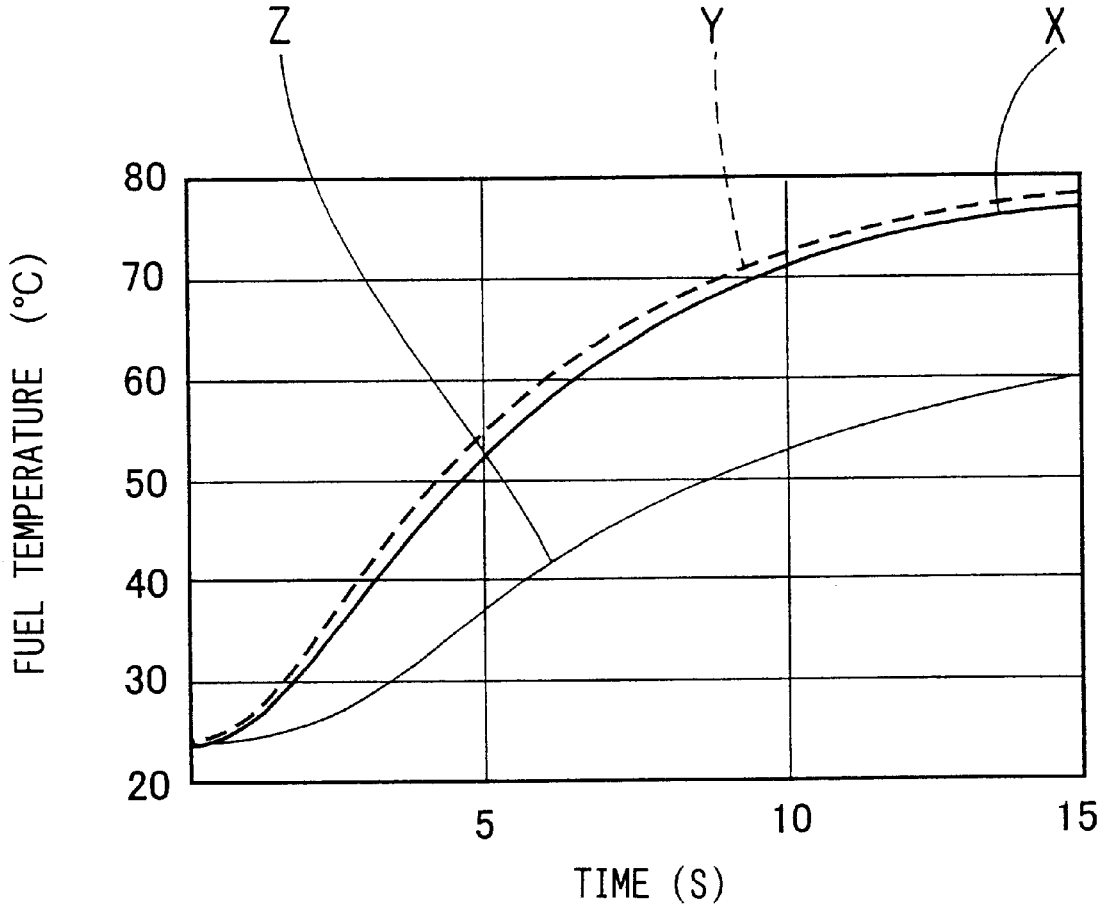
FIG. 4 is a graph showing a temperature increase of fuel for a predetermined time in the operation of the first embodiment.
Figure 8:
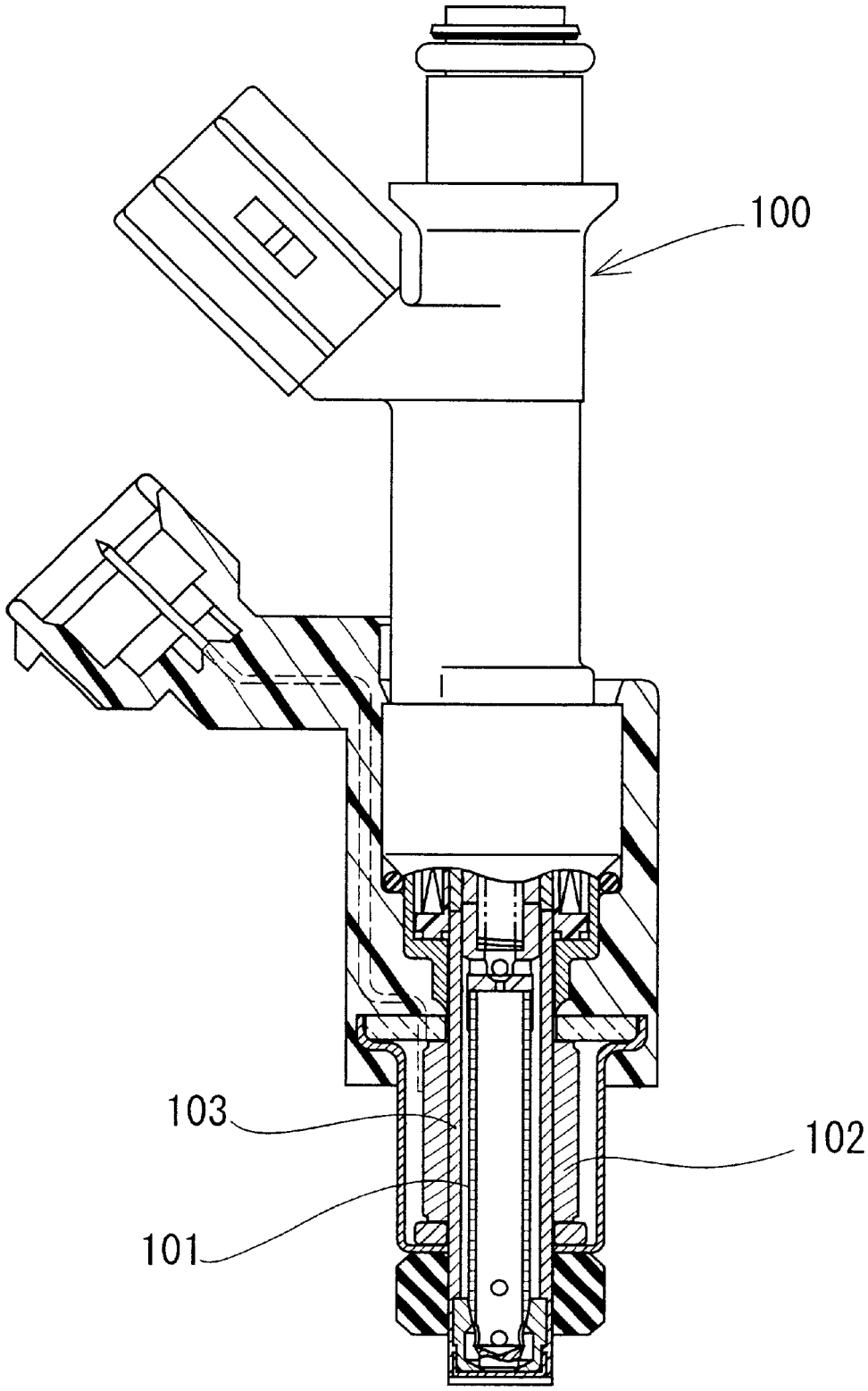
FIG. 8 RELATED ART
FIG. 8 is a side view of a fuel injector partly in section according to a related art.

FIG. 4 is a graph showing a temperature increase of the fuel sprayed from the orifices of the plate 16 after electric current supply to the ceramic heater is started. In the graph, a solid thick line X shows a temperature increase of this embodiment in which two ceramic heaters 50 are arranged on the outer periphery of the magnetic cylinder 11 in the circumferential direction. A dotted line Y shows that of a case (for example, FIG. 8) in which a cylindrical ceramic heater is press-fitted to the outer peripheral wall of the magnetic cylinder 11 without a clearance between the ceramic heater and the outer peripheral surface of the magnetic cylinder 11. A solid thin line Z shows that of a case in which a cylindrical ceramic heater is provided on the outer periphery of the magnetic cylinder 11 with a clearance between the cylindrical ceramic heater and the outer peripheral surface of the magnetic cylinder 11.

According to this comparison, it is preferable to press-fit the ceramic heater to the magnetic cylinder 11 without spacing between the ceramic heater and the outer peripheral surface of the magnetic cylinder, to improve heating efficiency of the fuel. However, ceramics does not have adequate durability against tensile strength. Therefore, it may be difficult to tightly press-fit the cylindrical ceramic heater on the outer peripheral surface of the magnetic cylinder 11 without clearance therebetween. In the case that the cylindrical ceramic heater is provided on the outer periphery of the magnetic cylinder with the clearance between the cylindrical ceramic heater and the outer peripheral surface of the magnetic cylinder 11, heating efficiency of the fuel is lowered. On the other hand, in this embodiment, the plurality of ceramic heaters 50 is mounted to surround the outer periphery of the magnetic cylinder 11. Therefore, the plurality of ceramic heaters 50 can be tightly fitted to the magnetic cylinder 11 without receiving too much tensile force, and hence can be less damaged. In this case, heat conductive efficiency to the magnetic cylinder 11 is not lessened, and as a result, the fuel inside of the magnetic cylinder 11 can be effectively heated.

In addition, since the plurality of ceramic heaters 50 is provided on the outer peripheral surface of the magnetic cylinder 11 and the slit 56 is provided on the holder 55, it is less likely that the ceramic heaters 50 will be damaged due to thermal expansion of the magnetic cylinder 11.

Second Embodiment

Figure 5:
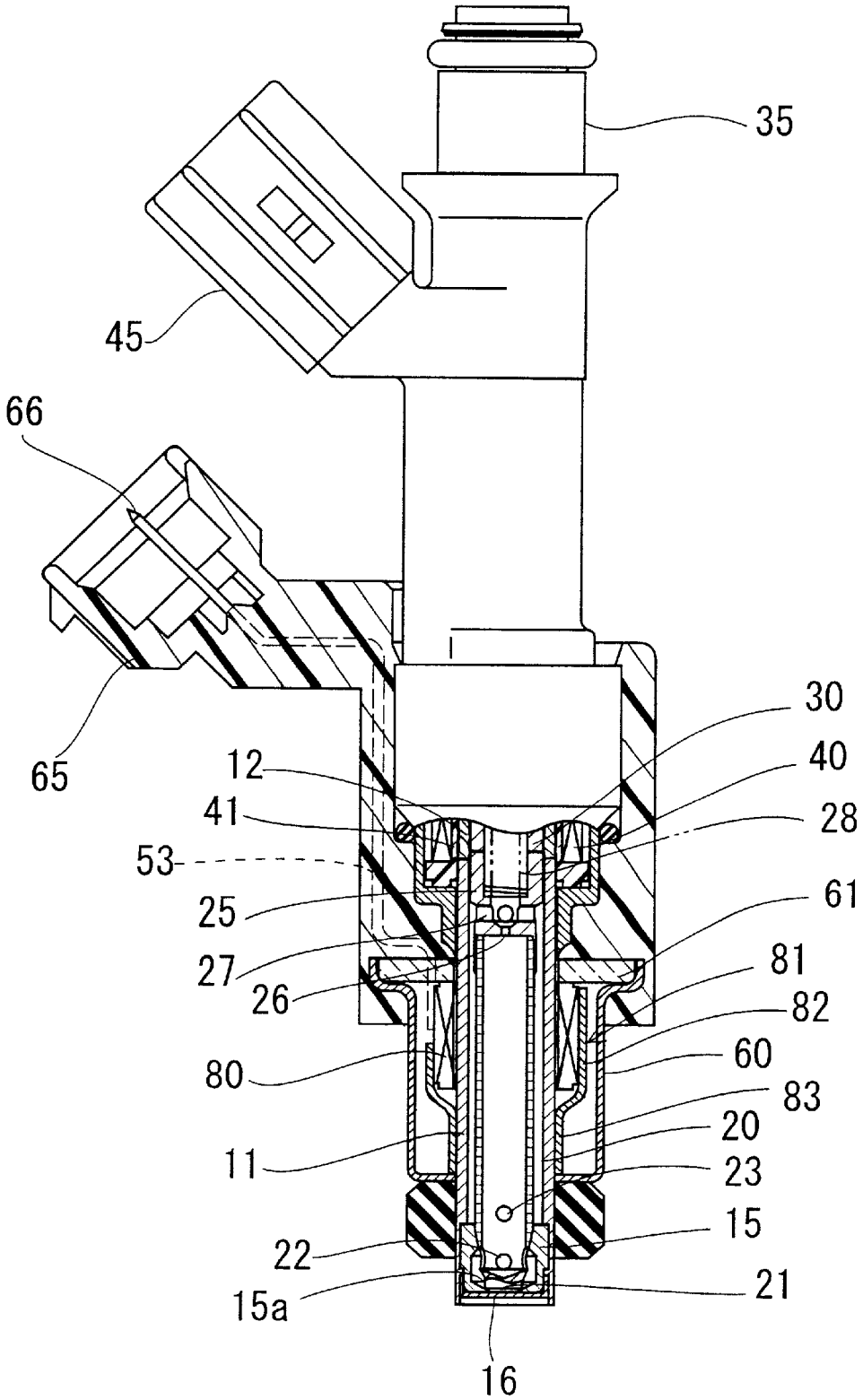
FIG. 5 is a side view of a fuel injector, partly in cross-section, according to the second embodiment of the present invention.
Figure 6:
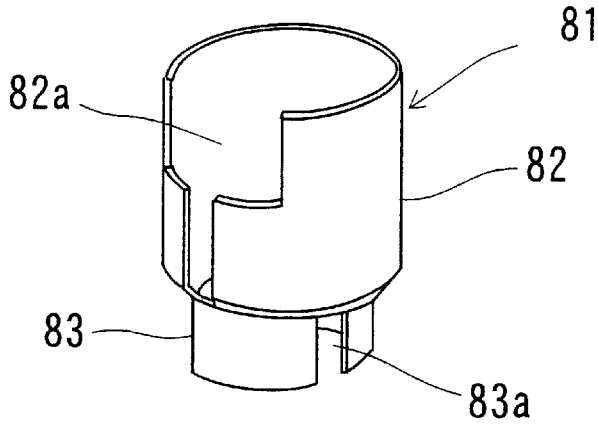
FIG. 6 is a perspective view of a heater holder used in the second embodiment.
Figure 7:
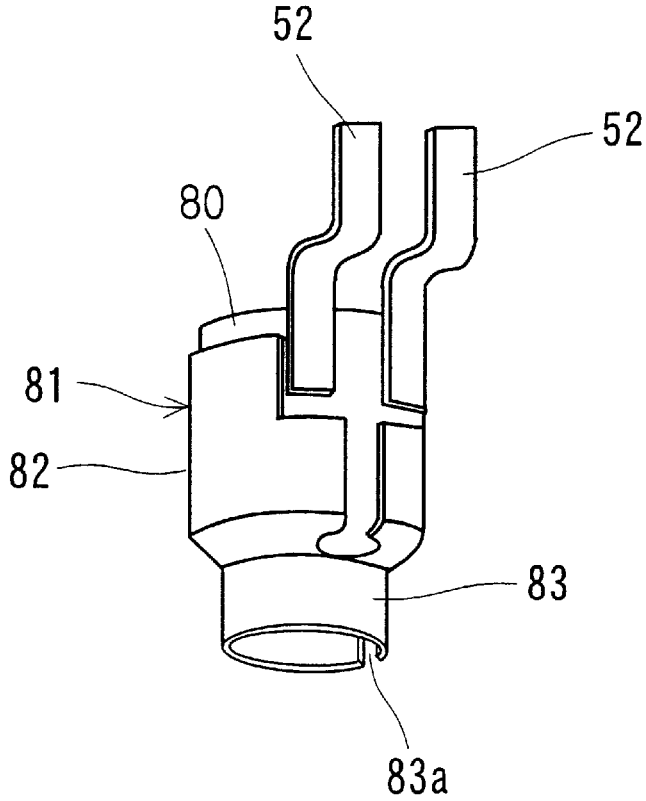
FIG. 7 is a perspective view of a ceramic heater fitted in the heater holder in the second embodiment.

The second embodiment is described hereinafter with reference to FIGS. 5 to 7. In the second embodiment, a ceramic heater 80, as a heating element, has a cylindrical-shape. The ceramic heater 80 is provided to surround the outer periphery of the magnetic cylinder 11. A heater holder 81 includes a large diameter part 82 and a small diameter part 83, as shown in FIGS. 6 and 7. The large diameter part 82 is integrated with the small diameter part 83. The heater holder 81 is made of a material having a good thermal conductivity, for example, copper and brass. The large diameter part 82 and the small diameter part 83 respectively provide a slit 82*a* and a slit 83*a* extending in the axial direction. The slit 82*a* does not correspond to the slit 83*a* in the circumferential direction.

The ceramic heater 80 is press-fitted in the large diameter part 82 while being affected by the large diameter part 82 with a small resiliency. That is, the large diameter part 82 surrounds the outer periphery of the ceramic heater 80 and contacts the ceramic heater 80. The small diameter part 83 is press-fitted on the outer peripheral wall of the magnetic cylinder 11 to contact the magnetic cylinder 11.

Since the ceramic heater 80 has the cylindrical-shape, it is difficult to tightly press-fit the ceramic heater 80 to the outer periphery of the magnetic cylinder 11. A clearance is provided between the inner peripheral surface of the ceramic heater 80 and the outer peripheral surface of the magnetic cylinder 11. Therefore, heat conductivity from the ceramic heater 80 directly to the magnetic cylinder 11 is lessened as compared with the ceramic heater 50 of the first embodiment. However, the heater holder 81 tightly contacts the outer peripheral surface of the ceramic heater 80 and the outer peripheral surface of the magnetic cylinder 11. Therefore, heat from the ceramic heater 80 is radially outwardly conducted to the heater cover 81 and the heat is further conducted to the magnetic cylinder 11. Therefore, the magnetic cylinder 11 is effectively heated by heat transmitted both inwardly and outwardly from the ceramic heater 80.

In the second embodiment, the ceramic heater 80 is used as a heating element. However, heating elements other than the ceramic heater can be used. The heater holder 81 of the second embodiment can be used with the ceramic heater 50 of the first embodiment.

In the above embodiments, the ceramic heaters 50 and 80 are press-fitted in the heater holder 55 and 81. However, it is difficult to uniformly size the ceramic heaters 50 and 80. Therefore, the ceramic heaters 50 and 80 may be brazed to the heater holders 55 and 81, instead of being press-fitted. Also in this case, the ceramic heaters 50 and 80 are tightly fixed to the heater covers 55 and 81. The valve member 20 may be in a cylindrical-shape having no hollow therein.

The present invention should not be limited to the disclosed embodiments, but may be implemented in other ways without departing from the spirit of the invention.

What is claimed is:

1. A fuel injector comprising:

a valve body having a cylindrical part defining a fuel passage and a valve seal at an end of the cylindrical part on a downstream fuel side and providing an orifice on a downstream fuel side of the valve seat;

a valve member enclosed and supported in the valve body to reciprocate in the fuel passage in an axial direction of the cylindrical part, the valve member having a contact portion on a downstream fuel side end to be seated on the valve seat to close the orifice;

a coil located on an outer periphery of the valve body, the coil generating a magnetic force for lifting the valve member from the valve seat when supplied with electricity; and a plurality of ceramic heaters provided on an outer peripheral surface of the cylindrical part axially between the valve seat and the coil, each of the plurality of ceramic heaters having an arc shape in cross section and being arranged in a circumferential direction to form a cylindrical shape in contact with an outer peripheral surface of the cylindrical part.

2. The fuel injector according to claim 1, further comprising a heater holder surrounding outer peripheral surfaces of the plurality of ceramic heaters and being in contact with the outer peripheral surface of the valve body.

3. The fuel injector according to claim 1, wherein the valve member has a hollow cylindrical-shape having a bottom at a downstream fuel side.

4. The fuel injector according to claim 1, further comprising:

a heater holder surrounding outer peripheral surfaces of the plurality of ceramic heaters;

a cover surrounding an outer periphery of the heater holder; and a resin part molded to surround an outer periphery of the coil and a part of an outer peripheral surface of the cover.

5. The fuel injector according to claim 4, wherein the cover has an opening adjacent to the coil and the opening is sealed with a sealing member.

6. A fuel injector comprising:

a valve body having a cylindrical part defining a fuel passage and a valve seal at an end of the cylindrical part on a downstream fuel side and providing an orifice on a downstream fuel side of the valve seat;

a plurality of ceramic heaters provided on an outer peripheral surface of the cylindrical part on an upstream fuel side of the valve seat, each of the plurality of ceramic heaters having an arc shape in cross section and being arranged in a circumferential direction to form a cylindrical shape in contact with an outer peripheral surface of the cylindrical part; and a heater holder surrounding outer peripheral surfaces of the plurality of ceramic heaters and being in contact with the outer peripheral surface of the valve body;

wherein the heater holder includes a large diameter part and a small diameter part, the plurality of ceramic heaters is inserted in the large diameter part and the small diameter part is press-fitted to the cylindrical part of the valve body.

7. The fuel injector according to claim 6, wherein the large diameter part and the small diameter part respectively provide slits extending in the axial direction to provide resiliency, each of the slits is located without corresponding to the other in a circumferential direction.

8. A fuel injector comprising:

a valve body having a cylindrical part defining a fuel passage and a valve seat at an end of the cylindrical part on a downstream fuel side and providing an orifice on a downstream fuel side of the valve seat;

a valve member enclosed and supported in the valve body to reciprocate in the fuel passage in an axial direction of the cylindrical part, the valve member having a contact portion on a downstream fuel side end to be seated on the valve seat to close the orifice and lifted from the valve seat to open the orifice;

a heating element provided on an outer peripheral surface of the cylindrical part of the valve body on an upstream fuel side of the valve seat; and a holder surrounding an outer periphery of the heating element and being in contact with both the outer periphery of the heating element and the outer peripheral surface of the cylindrical part of the valve body, wherein the holder is made of metal.

9. The fuel injector according to claim 8, wherein the heating element is a ceramic heater.

10. The fuel injector according to claim 9, wherein the ceramic heater has a cylindrical shape and press-fitted in the holder.

11. The fuel injector according to claim 9, wherein the ceramic heater is brazed with the holder.

12. The fuel injector according to claim 8, wherein the holder contacts the outer peripheral surface of the cylindrical part of the valve body axially between the heating element and the valve seat.

13. The fuel injector according to claim 12, wherein the holder has a large diameter part and a small diameter part, the large diameter part contacting the outer peripheral surface of the heating element, and the small diameter part contacting the outer peripheral surface of the cylindrical part of the valve body.

14. The fuel injector according to claim 8, wherein the valve member has a hollow cylindrical part having a bottom on a valve seat side.

15. The fuel injector according to claim 8, further comprising a cover surrounding an outer periphery of the holder with a predetermined space.

16. A fuel injector comprising:

a valve body having a cylindrical part defining a fuel passage and a valve seal at an end of the cylindrical part on a downstream fuel side and providing an orifice on a downstream fuel side of the valve seat;

a plurality of ceramic heaters provided on an outer peripheral surface of the cylindrical part on an upstream fuel side of the valve seat, each of the plurality of ceramic heaters having an arc shape in cross section and being arranged in a circumferential direction to form a cylindrical shape in contact with an outer peripheral surface of the cylindrical part; and a heater holder surrounding outer peripheral surfaces of the plurality of ceramic heaters and being in contact with the outer peripheral surface of the valve body, wherein the heater holder has a slit extending in an axial direction to provide resiliency.

17. A fuel injector comprising:

a valve body having a cylindrical part defining a fuel passage and a valve seat at an end of the cylindrical part on a downstream fuel side and providing an orifice on a downstream fuel side of the valve seat;

a valve member enclosed and supported in the valve body to reciprocate in the fuel passage in an axial direction of a cylindrical part, the valve member having a contact portion on a downstream fuel side end to be seated on the valve seat to close the orifice and lifted from the valve seat to open orifice;

a heating element provided on an outer peripheral surface of the cylindrical part of the valve body on an upstream fuel side of the valve seat; and a holder surrounding an outer periphery of the heating element and being in contact with both the outer periphery of the heating element and the outer peripheral surface of the cylindrical part of the valve body, wherein the holder has a large diameter part and a small diameter part, the heating element is press-fitted in the large diameter part and the small diameter part is press-fitted on the cylindrical part of the valve body.

18. The fuel injector according to claim 17, wherein the large diameter part and the small diameter part respectively provide slits extending in the axial direction, and each of the slits is located without corresponding to the other in a circumferential direction.

19. A fuel injector comprising:

a valve body having a cylindrical part defining a fuel passage and a valve seat at an end of the cylindrical part on a downstream fuel side and providing an orifice on a downstream fuel side of the valve seat;

a valve member enclosed and supported in the valve body to reciprocate in the fuel passage in an axial direction of a cylindrical part, the valve member having a contact portion on a downstream fuel side end to be seated on the valve seat to close the orifice and lifted from the valve seat to open orifice;

a heating element provided on an outer peripheral surface of the cylindrical part of the valve body on an upstream fuel side of the valve seat; and a holder surrounding an outer periphery of the heating element and being in contact with both the outer periphery of the heating element and the outer peripheral surface of the cylindrical part of the valve body, wherein the heating element is fitted around the outer peripheral surface of the cylindrical part of the valve body more loosely than the holder is fitted around the outer periphery of the heating element.

* * * * *